United States Patent [19]

Rickard et al.

[11] 4,444,521

[45] Apr. 24, 1984

[54] PRINT MEDIUM ADVANCING MECHANISM INCLUDING PRINT HEAD RETRACTION

[75] Inventors: Bruce W. Rickard, Kettering; Bernard Fisher, Englewood, both of Ohio

[73] Assignee: United Systems Corporation, Dayton, Ohio

[21] Appl. No.: 404,095

[22] Filed: Aug. 2, 1982

[51] Int. Cl.[3] ..... B41J 3/20

[52] U.S. Cl. ..... 400/120; 400/320; 400/568; 400/569; 400/636; 400/902; 400/903; 400/904; 400/185; 346/76 PH; 346/136

[58] Field of Search ..... 400/118, 119, 120, 320, 400/568, 569, 636, 902, 903, 185, 404; 346/76 R, 76 PH, 76 L, 136

[56] References Cited

U.S. PATENT DOCUMENTS

| | | | |
|---|---|---|---|
| Re. 29,832 | 11/1978 | Hayakawa | 400/120 X |
| 3,787,886 | 1/1974 | McCrady | 400/120 X |
| 3,810,192 | 5/1974 | Okabe | 346/136 X |
| 3,845,850 | 11/1974 | Herr et al. | 400/120 |
| 3,855,448 | 12/1974 | Hanagata et al. | 346/76 PH X |
| 3,951,247 | 4/1976 | Montanari | 400/120 |
| 3,955,663 | 5/1976 | Ecker | 400/120 X |
| 4,013,159 | 3/1977 | Okabe | 400/120 |
| 4,030,587 | 6/1977 | Walker | 400/120 X |
| 4,030,588 | 6/1977 | Hanagata et al. | 400/320 X |
| 4,173,273 | 11/1979 | Hanakata | 400/903 X |
| 4,350,987 | 9/1982 | Hanagata et al. | 346/76 PH |

*Primary Examiner*—Ernest T. Wright, Jr.

*Attorney, Agent, or Firm*—Biebel, French & Nauman

[57] ABSTRACT

A single stepper motor is utilized in a printing device to lift a print head from the surface of recording material upon the initial angular rotation of the stepper motor output drive shaft and to move the recording material within the printing device upon further rotation of said drive shaft. The print head is returned to the surface of the recording material by operating the stepper motor in the reverse direction until the output drive shaft of the stepper motor traverses an angular displacement equal but opposite to the initial angular displacement. A cam surface couples the output drive shaft of the stepper motor to a drive gear and transforms the initial angular displacement of the output drive shaft into linear motion to lift the print head from the surface of the recording material. Further rotation of the stepper motor drive shaft rotates the drive gear to move material within the printing device. Cam configurations are disclosed for movement of the paper in one or both directions through the printing device.

11 Claims, 4 Drawing Figures

PRINT MEDIUM ADVANCING MECHANISM INCLUDING PRINT HEAD RETRACTION

BACKGROUND OF THE INVENTION

This invention relates generally to apparatus for printing information on recording material such as thermal or electrosensitive paper and, more particularly, to a mechanism which utilizes a single stepper motor to control both the motion of the recording material past a print head and also the retraction of the print head from the recording material surface as the material is moved.

Printers for generating hard copy readout on recording material such as thermal or electrosensitive paper are used extensively for electronic devices such as data terminals, calculators, cash registers and the like. Such information takes the form of alpha-numeric characters as well as symbolic and graphic printouts.

Typically, in such printing apparatus, a print head is moved across a web of recording material to print a line of information onto the web of material. The web is then advanced so that the next line of information can be printed. Both the print head and the recording material are moved rapidly in the printing apparatus to accommodate the rapid printing speeds required by modern-day users. Often the print head includes needle-like elements organized into a matrix to print the required information or other projecting elements which may catch or snag the recording material as the material is moved past the print head. Contact between the print head and the recording material causes unsightly marks on the material and wears away the print head over time. To prevent such problems, the print head is often lifted from the recording material as the material is advanced.

Various mechanisms for lifting the print head and moving the recording material have been provided in the prior art. For example, a thermal printer is disclosed in U.S. Pat. No. 3,845,850 which was issued on Nov. 5, 1974 to Herr et al. The printer includes a print head which is moved laterally across a sheet of thermally sensitive paper backed by a roller or platen. The print head is moved by a stepper motor. Over the majority of its travel, the print head is held in contact with the thermally sensitive paper. Toward one end of its travel, a projection from a print head carriage engages a ramp which lifts the head from the thermally sensitive paper as the carriage is moved.

If the print head carriage is driven beyond the print head lifting point, a ratchet mechanism rotates the platen to advance the thermally sensitive paper by one line increment. In the mechanism disclosed in this patent, the recording paper can be advanced and the print head raised only when the print head is at one side of the recording paper. Also, the recording paper can be moved in only one direction through the printer.

A second recording material advancing mechanism for a thermal printer is disclosed in U.S. Pat. No. 3,787,886 issued on Jan. 22, 1974 to McCrady. In this printer, a single solenoid activates two rocking mechanisms. The first rocking mechanism includes a one way clutch arrangement to pinch the recording material when rocked in one direction by operation of the solenoid and to thereby draw the material in that direction. The material is released when the first rocking mechanism is rocked in the other direction to return the first rocking mechanism to its initial position without affecting the position of the recording material. The second rocking mechanism comprises a print head which is retracted from the recording material upon activation of the solenoid.

The mechanism disclosed in this patent simultaneously advances the recording material while releasing the print head from engagement with the material. Here again, the material can only be moved in one direction through the printer and the simultaneous retraction of the print head from the recording material may not prevent marking or snagging of the material by the print head in all cases.

A third recording material advance mechanism is disclosed in U.S. Pat. No. 3,955,663 issued on May 11, 1976 to Ecker. In this mechanism, a single solenoid initially advances the recording material by one line increment and then forces the material against a printing head. Here again, the mechanism can only provide for movement of the recording material in one direction through the printing machine and is mechanically complex.

Thus, the need exists for an improved mechanism for coordinating the motion of a print head as material to be printed upon is moved within a printing device.

SUMMARY OF THE INVENTION

In accordance with the present invention, a single stepper motor is utilized to initially lift a print head from the surface of recording material in a printing device and thereafter to move the material within the printing device. The print head is returned to the surface of the recording material by reversing the operating direction of the stepper motor.

The dual functioning of the stepper motor is accomplished by coupling means which connects the stepper motor to drive means. The coupling means transforms the rotational motion of a drive shaft of the stepper motor over an initial defined angular displacement into linear motion of the drive means. The linear motion of the drive means activates a lever arm to lift the print head from the recording material. Further rotation of the stepper motor beyond the initial defined angular displacement provides rotational motion to the drive means for moving the recording medium within the printing device. The coupling means is retracted by reversing the stepper motor until the drive means and lever arm return to their original positions. In the preferred embodiment of the present invention, the coupling means comprises a cam fixed to the drive means and a cam activating pin fixed to the drive shaft of the stepper motor.

Movement of the recording material is performed by a recording material drive roller which is engaged by one or more tensioning rollers. The drive roller include a first gear which is engaged by the drive means. The drive means comprises a second gear which slidingly receives the stepper motor drive shaft and slidingly engages the drive roller gear. The print head is biased to a print position, i.e., against the recording material extended over a backing surface or platen, by a resilient means preferably comprising a tensioned spring.

It is, therefore, an object of the present invention to provide an improved mechanism for coordinating the positioning of a print head relative to recording material with the movement of that recording material within a printing device by means of a single stepper motor; to provide an improved mechanism for moving recording material within a printing device and also for retracting a print head from the recording material before the material is moved; and to provide an improved recording material advancing mechanism wherein a single stepper motor initially imparts linear motion to a drive gear for retracting a print head from the surface of a recording material and thereafter rotates the drive gear to move the recording material, the print head being returned to the surface of the recording material for printing by operation of the stepper motor in the reverse direction.

Other objects and advantages of the invention will be apparent from the following description, the accompanying drawing and the appended claims.

DETAILED DESCRIPTION OF THE INVENTION

Figures 1, 2, 3A, 3B:
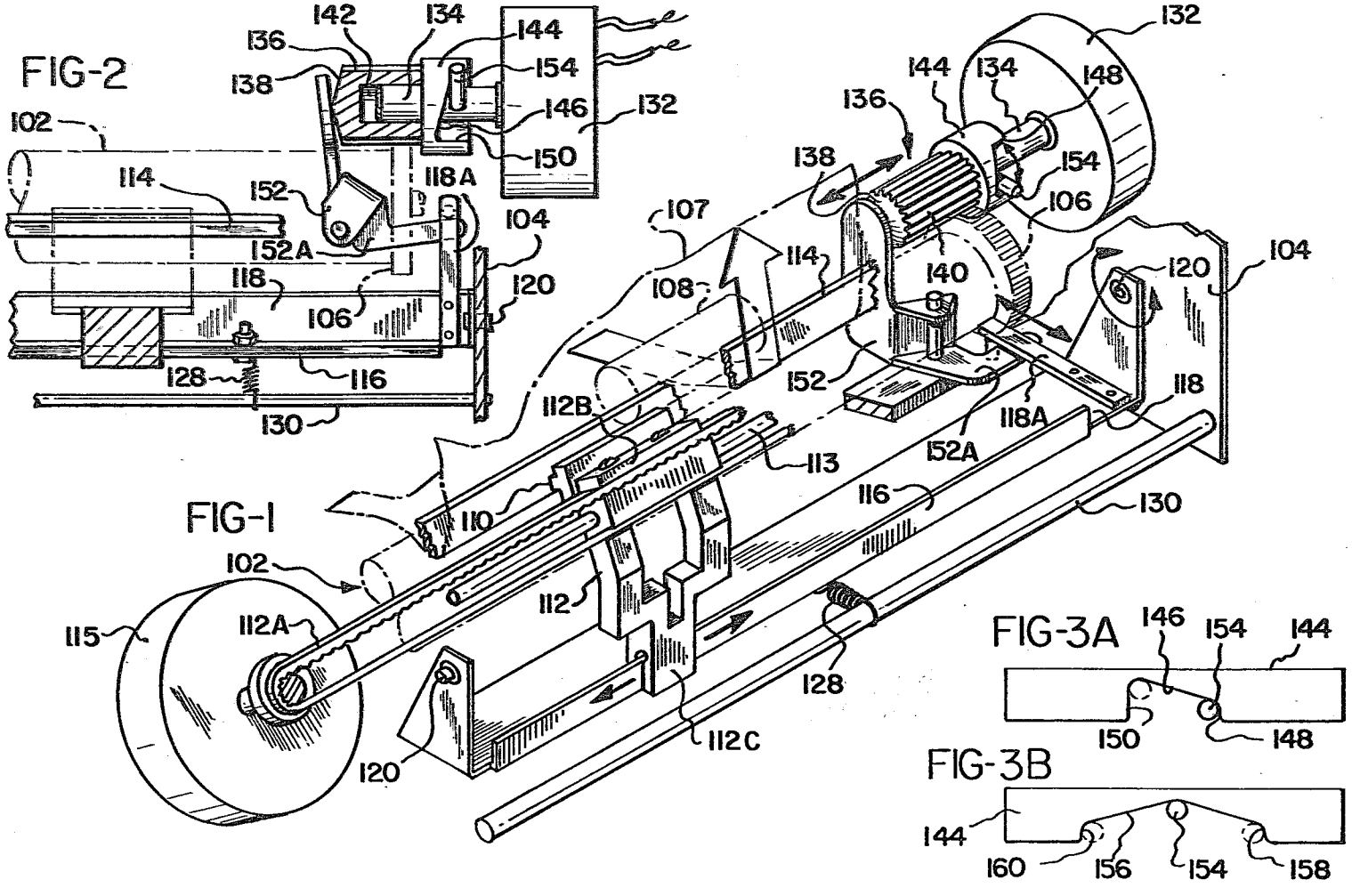
FIG. 1 is a partially sectioned perspective view of the print head and recording material handling mechanism for a printing device in accordance with the present invention.
FIG. 2 is a plan view of the apparatus located at the right-hand end of FIG. 1.
FIG. 3A is a developed view of a cam surface for advancing the recording material within a printer.
FIG. 3B is a developed view of a cam surface for moving the recording material in either direction within a printer.

FIG. 1 is a partially sectioned perspective view of a print head and associated drive roller incorporating the mechanism in accordance with the present invention. A recording material drive roller 102 is mounted for rotation between a right-hand side wall 104 and a left-hand side wall (not shown). A drive gear 106 is fixed to the drive roller 102. Recording material 107 such as thermal or electrosensitive paper is moved within the machine between the drive roller 102 and a number of tensioning rollers illustrated by a tensioning roller 108.

A print head 110 is carried on a carriage 112. The carriage 112 is slidingly mounted on a cylindrical shaft 113 for transverse movement back and forth across recording material 107 positioned against a backing surface or platen 114. The shaft 113 is mounted between the right-hand side wall 104 and the left-hand side wall (not shown). The print head carriage 112 is moved across the platen 114 by a stepper motor 115. The stepper motor 115 drives a toothed belt 112A which is secured to the print head carriage 112 by a clamp 112B. The belt 112A is driven by the stepper motor 115 to propel the print head carriage 112 back and forth along the shaft 113.

The mounting of the carriage 112 also permits pivotal movement of the carriage 112 about the shaft 113 to selectively engage the print head 110 with the recording material 107. An extension 112C of the carriage 112 is slotted to receive a flange 116 of a pivotally mounted print head control member 118. The print head control member 118 is pivotally mounted on the right-hand side wall 104 and the left-hand side wall (not shown) by pins 120.

The print head 110 is held in a printing position, i.e., against recording material 107 covering the platen 114, by means of a tensioned spring 128 which extends between the print head control member 118 and a bar 130 mounted between the right-hand side wall 104 and the left-hand side wall (not shown).

The pivotal motion of the print head carriage 112 and the rotation of the drive roller 102 to move paper through the printing device are controlled by a single stepper motor 132. The stepper motor 132 can be pulsed to rotate an output drive shaft 134 in either direction. A drive gear 136 includes a closed distal end 138, a central exterior toothed portion 140, and an axially aligned bore 142 for slidingly receiving the stepper motor drive shaft 134.

Means for coupling the drive gear 136 to the output drive shaft 134 of the stepper motor 132 comprises a collar 144 having a cam surface 146 extending between first and second surfaces 148 and 150, respectively, which surfaces 148, 150 run parallel to the axis of the drive gear 136. The collar 144 can be formed as a separate part and affixed to the drive gear 136 or the collar 144 can be formed as an integral part of the drive gear 136.

The distal end 138 of the drive gear 136 abuts a pivotally mounted lever arm 52 which takes the form of a crank in the illustrative embodiment. The lever arm 152 is coupled to the print head control member 118 through an extension 152A which engages an extension 118A of the member 118. Due to the force of the spring 128 acting on the print head control member 118, the lever arm 152 exerts a force on the distal end 138 of the gear 136 to tend to force the gear 136 onto the drive shaft 134 of the stepper motor 132. This ensures that a drive pin 154 affixed to the output drive shaft 134 engages the cam surface 146 in the collar 144.

As shown in FIG. 1, the drive shaft 134 of the stepper motor 132 is in the print position. In this position, the gear 136 is retracted so that the print head 110 is engaged with the recording material 107 due to the force of the tensioned spring 128. A line of information is then printed with the print head 110 by operating the stepper motor 115 to move the print head carriage 112 and, hence, the print head 110 across the platen 114. When the recording material 107 is to be moved, the stepper motor 132 is operated to move the drive shaft 134 in the counter-clockwise direction as shown in FIG. 1. During the initial angular displacement of the drive shaft 134, the drive pin 154 engages the cam surface 146 to thereby force the gear 136 to the extended position shown in FIG. 2 and lift the print head 110 from the surface of the recording material 107.

After this initial angular displacement of the drive shaft 134, the drive pin 154 engages the first surface 148 which serves as a rotational drive surface for advancing the recording material 107 within a printing machine. Further rotational motion of the drive shaft 134 beyond the initial angular displacement causes the gear 136 to rotate which in turn rotates the drive roller 102 through the drive gear 106 to advance recording material 107 through the printing device.

With the mechanism of the present invention, the recording material 107 can be advanced by any amount desired from one line to a page or more. After the desired advance of the recording material 107, the stepper motor 132 is operated in the reverse direction, i.e., in the clockwise direction as shown in FIG. 1. This reverse operation of the stepper motor 132 causes the gear 136 to be retracted as the drive pin 154 moves along the cam face 146 from the first surface 148 to the second surface 150. At this point, the stepper motor 132 is stopped and a new line of information is printed across the recording material 107.

The recording material 107 can be moved in a reverse direction through the machine by operation of the stepper motor drive shaft 134 in the clockwise direction after the drive pin 154 has engaged the second surface 150 which then serves as a rotational drive surface for retracting the recording material 107 within a printing machine. Such reverse operation is advantageous, for example, for superscripting or for certain graphic applications. However, with the cam face 146 shown in FIGS. 1, 2 and 3A, the print head 110 would remain in contact with the surface of the recording material 107 as the material 107 is retracted and could snag the material 107 and lead to the problems previously described.

It is preferred, therefore, in accordance with the present invention that a double cam face 156 as shown in FIG. 3B be provided if the paper is to be moved in both directions through the printing machine. When the double cam face 156 is utilized, the print head 110 is lifted from the surface of the recording material 107 by the initial angular rotation of the stepper motor output drive shaft 134 regardless of the direction of rotation. As shown in the developed view of FIG. 3B, the cam face 156 includes a first rotational drive surface 158 for advancing the recording material 107 within the printing device and a second rotational drive surface 160 for retracting or moving the recording material 107 in the reverse direction in the printing device.

For printing operations with the cam face 156, the drive shaft 134 of the stepper motor 132 is positioned so that the drive pin 154 is in the center of the cam face 156 as hown by the solid line drawing in FIG. 3B. This position of the drive pin 154 along the cam face 156 places the print head 110 against the recording material 107 on the platen 114.

For advancing the recording material 107 within the printing device, the stepper motor 132 is operated to turn the drive shaft 134 in the counter-clockwise direction until the drive pin 154 operating on the right-hand portion of the cam surface 156 engages the rotational drive surface 158. This initial angular displacement of the drive shaft 134 lifts the print head 110 so that the recording material 107 can then be advanced within the printing device by additional counter-clockwise rotation of the stepper motor 132 drive shaft 134. After the desired advance of the recording material 107, the direction of operation of the stepper motor 132 is reversed and the drive pin 154 is returned to the solid line position shown in FIG. 3B. The interaction of the drive pin 154 and the cam face 156 restores the print head 110 to contact with the recording material 107 for further printing operations.

For moving the recording material 107 in the reverse direction through the printing device, the stepper motor 132 is operated to turn the drive shaft 134 in the clockwise direction, as shown in FIG. 1, so that the drive pin 154 engages the left-hand portion of the cam face 156 as shown in FIG. 3B. The left-hand portion of the cam face 156 is the mirror image of the right-hand portion to similarly lift the print head 110 from the surface of the recording material 107 as the drive pin 154 moves from the center position in FIG. 3B to engagement with the second rotational drive surface 160. Additional rotation of the drive shaft 134 of the stepper motor 132 in the clockwise direction then causes the drive roller 102 to rotate to move the recording material 107 in the reverse direction. Thus, with the cam shown in the developed view of FIG. 3B, the material 107 can be moved in either direction through the printing device with the print head 110 being initially lifted from the surface of the material 107 prior to the movement of the material 107.

In accordance with the present invention, the print head 110 can be lifted at any position across the platen 114 and recording material 107 can then be moved in one or both directions through the printer. Such operation facilitates the printing of information and permits more advanced operating features for a printer, for example, printing information in both the forward and reverse directions as the print head 110 travels back and forth across the platen 114.

While the forms of apparatus herein described constitute preferred embodiments of this invention, it is to be understood that the invention is not limited to these precise forms of apparatus and that changes may be made therein without departing from the scope of the invention which is defined in the appended claims.

What is claimed is:

1. In printing apparatus including printing means for recording information on a continuous web of recording material, material control means for engaging said recording material to move said recording material before said printing means, and printing control means for selectively positioning said printing means against said material for printing thereon and away from said material for movement thereof, the improvement comprising:

a stepper motor;

drive means for engaging and controlling said material control means and said printing control means; and coupling means interposed between said stepper motor and said drive means for imparting linear motion to said drive means for activating said printing control means and for imparting rotational motion to said drive means for activating said material control means.

2. The printing apparatus of claim 1 wherein said material control means comprises a drive roller, at least one tensioning roller engaging said drive roller and a first gear firmly affixed to said drive roller, and said drive means comprises a second gear slidingly intermeshed with said drive roller gear to permit linear movement of said second gear.

3. The printing apparatus of claim 2 further comprising resilient means for biasing said printing control means to maintain said printing means against said recording material within said printing apparatus and said printing control means comprises a lever arm coupled between the distal end of said second gear and said printing means so that linear motion of said second gear moves said printing means away from said recording material against the force of said resilient means and toward said recording material under the force of said resilient means.

4. The printing apparatus of claim 3 wherein said coupling means comprises cam means.

5. The printing apparatus of claim 4 wherein said stepper motor rotates an output drive shaft, said second gear encircles and slidingly receives said drive shaft, said cam means comprises a cam surface formed into said second gear, and said drive shaft includes a cam activating pin extending laterally therefrom to engage said cam surface so that rotation of said drive shaft through an initial angular displacement laterally extends said second gear to lift said printing means from engagement with said recording material and additional rotation of said drive shaft beyond said initial angular displacement rotates said second gear to move said recording material within said printing apparatus.

6. The printing apparatus of claim 4 wherein said stepper motor rotates an output drive shaft; said second gear encircles and slidingly receives said drive shaft, said cam means comprises a collar affixed to said second gear which collar encircles said drive shaft and has a cam surface formed therein facing said stepper motor, and said drive shaft includes a cam activating pin extending laterally therefrom to engage said cam surface so that rotation of said drive shaft through an initial angular displacement laterally extends said second gear to lift said printing means from said recording material and additional rotation of said drive shaft beyond said initial angular displacement rotates said second gear to move said recording material within said printing apparatus.

7. In printing apparatus including a recording material drive roller, a recording material backing platen, a print head mounted for transverse movement longitudinally along said platen and for pivotal movement away from said platen, and resilient means for biasing said print head toward said platen, improved apparatus for moving recording material through said printing apparatus and for coordinating the pivotal movement of said print head with the movement of said material comprising:

a first gear affixed to said drive roller;

a pivotally mounted lever arm having a first end coupled to said print head for controlling the pivotal movement of said print head and a second end;

a stepper motor including an output shaft;

a generally cylindrical drive gear being closed on one end and having an axially aligned bore extending into the opposite end for slidingly receiving said output shaft, said drive gear being positioned to slidingly engage said first gear with the distal end of said drive gear abutting said second end of said lever arm; and coupling means connected to said drive gear and said output shaft for imparting linear motion to said drive gear upon initial rotational motion of said output shaft and for imparting rotational motion to said drive gear for rotational motion of said output shaft thereafter.

8. The improved apparatus of claim 7 wherein said coupling means comprises a cam surface formed into said drive gear and a cam driving pin extending from said output shaft for engaging said cam surface.

9. The improved apparatus of claim 7 wherein said coupling means comprises a cam surface connected to said drive gear and a cam driving pin connected to said output shaft for engaging said cam surface.

10. The improved apparatus of claim 7 wherein said coupling means comprises a cam surface extending between first and second rotational driving surfaces and a cam driving pin extending from said output shaft for engaging said cam surface whereby upon initial rotation of said output shaft in one direction from a rest position said cam driving pin acts upon said cam surface to axially extend said drive gear in the direction of said distal end of said drive gear until said drive pin engages said first rotational driving surface with additional rotation of said output shaft in the same direction resulting in rotational motion of said drive gear in said direction and rotation of said output shaft in the opposite direction resulting in axial retraction of said drive gear toward its original position.

11. The improved apparatus of claim 10 wherein initial rotation of said output shaft in said opposite direction from said rest position initially results in axial extension of said drive gear until said drive pin engages said second rotational driving surface with additional rotation of said output shaft in said opposite direction resulting in rotational motion of said drive gear in said opposite direction and rotation of said output shaft in said one direction resulting in axial retraction of said drive gear toward its original position.

* * * * *